United States Patent [19]

Lowden

[11] 4,179,179

[45] Dec. 18, 1979

[54] ELECTRICAL CONNECTOR HAVING MULTIPLE TERMINAL RECEPTACLE RECEIVING DIFFERENT PLUGS

[75] Inventor: Lawrence C. Lowden, Kansas City, Mo.

[73] Assignee: Whitaker Cable Corporation, North Kansas City, Mo.

[21] Appl. No.: 906,736

[22] Filed: May 17, 1978

[51] Int. Cl.[2] ..... H01R 13/54

[52] U.S. Cl. ..... 339/186 M; 339/92 M; 339/126 RS

[58] Field of Search ..... 339/92 R, 93 R, 126 RS, 339/129, 49 R, 186 M, 185 R, 196 A, 92 M; 248/27.3

[56] References Cited

U.S. PATENT DOCUMENTS

| | | | |
|---|---|---|---|
| 2,744,185 | 5/1956 | Cawley | 248/27.3 X |
| 2,824,290 | 2/1958 | Archer et al. | 339/49 R |
| 3,686,617 | 8/1972 | Uberbacher | 339/49 R |
| 3,853,381 | 12/1974 | Morningstar | 339/92 M |

FOREIGN PATENT DOCUMENTS

| | | | |
|---|---|---|---|
| 625792 | 8/1961 | Canada | 339/129 |
| 1590403 | 7/1970 | Fed. Rep. of Germany | 339/126 RS |

OTHER PUBLICATIONS

"Connectors-Molded Disconnects", Whitaker, Advertisement C-10, Feb. 1973.

*Primary Examiner*—E. F. Desmond

*Attorney, Agent, or Firm*—Schmidt, Johnson, Hovey & Williams

[57] ABSTRACT

A multiple contact electrical connector is provided with a universal receptacle adapted to mate alternatively with a single plug or various combinations of plugs while maintaining polarity of the contacts in the connector. The receptacle is provided with a resilient exterior for forming weatherseals at the interface between mating male and female terminals in the connector, yet also has a rigid central core providing sufficient strength for positive coupling with the mating plugs. In preferred forms, each plug has a centrally attached threaded bolt adapted to be received within a complemental insert formed in the rigid core of the receptacle for facilitating coupling and uncoupling of the plugs with the receptacle and for locking mating terminals in electrical contact with one another. The resilient receptacle is particularly adapted for releasable sealed mounting on the firewall of a motor vehicle by virtue of the provision of a removable U-shaped clip which captively engages the firewall in cooperation with a flange formed in the resilient body of the receptacle.

16 Claims, 10 Drawing Figures

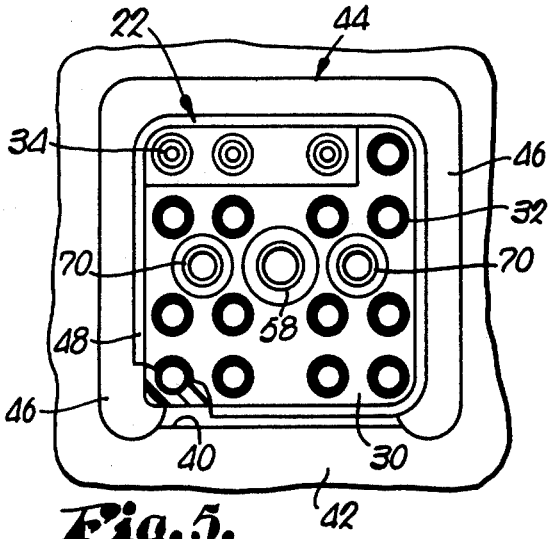
Fig. 5.
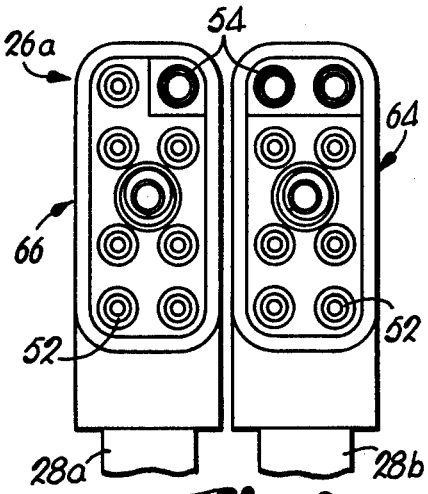
Fig. 6.
Fig. 7.
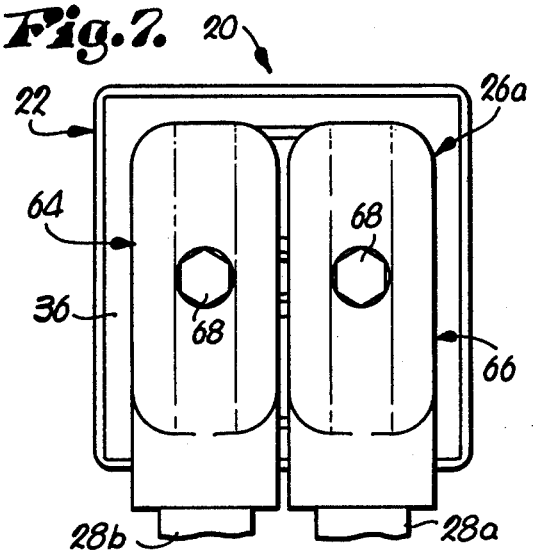
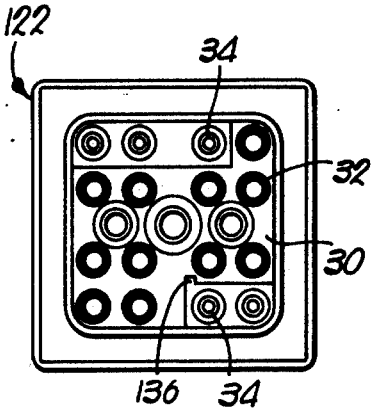
Fig. 8.
Fig. 9.
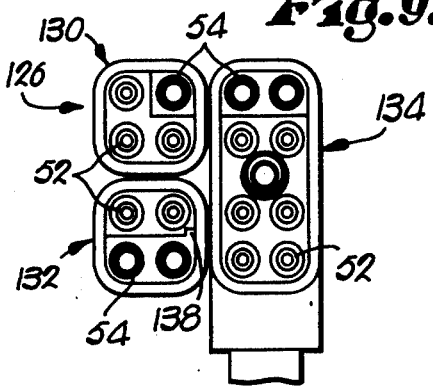
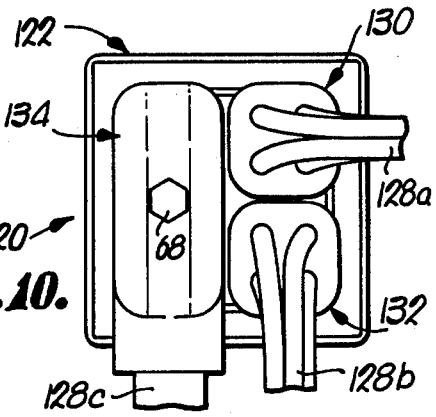
Fig. 10.

ELECTRICAL CONNECTOR HAVING MULTIPLE TERMINAL RECEPTACLE RECEIVING DIFFERENT PLUGS

TECHNICAL FIELD

This invention relates to electrical connectors in general and particularly concerns improved multiple contact connectors of the type utilized to interconnect wiring harnesses such as found in the electrical system of a motor vehicle.

BACKGROUND ART

In the fabrication of automobiles, trucks, and similar vehicles, it is required that numerous electrical wires pass through the firewall of the vehicle between the operator compartment and the space in which the vehicle motor is housed. Since the passageway for these wires must be sealed to maintain the integrity of the firewall as well as to protect against the elements, it is common practice to pass all wires through the firewall at a limited number of predetermined locations rather than having a multitude of discrete sealed passageways for each individual circuit. Such an arrangement is particularly desirable in electrical systems of large trucks, for example, which may have in excess of 150 separate circuits.

In order to provide desired sealing at the firewall as well as to facilitate initial fabrication of the vehicle, multiple-contact electrical connectors for the wiring harnesses are typically provided at the firewall. The receptacle of the connector normally passes through the firewall in sealing engagement therewith. Wires on opposite sides of the firewall may thereby be quickly and easily interconnected eliminating the need to provide a separate seal for each circuit extending through the firewall.

Of course, it is important that wires on one side of the firewall be electrically coupled with appropriate wires on the opposite side of the firewall for proper operation of the vehicle electrical system; in other words, polarity across the firewall-mounted connector must be maintained. Typically, connectors of this type are provided with polarizing means to preclude misorientation of the plug relative to the receptacle.

One problem with connectors of the type described above is the difficulty in readily adapting them to various designs of vehicles. In this regard, the receptacle and plug of the connector are usually prefabricated to include various lengths of wires selected to meet the design needs of that particular vehicle. In order to incorporate the connector in other vehicles of similar design, it is often desired to utilize smaller wire harnesses and different configurations of plugs. However, heretofore it has always been required to employ a separate receptacle for mating with each type of plug or combinations of plugs and hence, it has not been economically practical to provide custom connectors tailored to meet the needs of a particular application.

In this latter regard, receptacles designed to mate with one size plug, and which would otherwise be compatible with various combinations of smaller plugs, are not suited for use with multiple plugs because the polarizing means of the receptacle is nullified. For example, when two plugs are used to replace a single plug in a connector of given design, only one of the plugs will be controlled by the polarizing means in the original receptacle, the other of the plugs being permitted to mate in a number of different orientations.

A second problem with prior art connectors relates to corrosion and ultimate dielectric breakdown in areas adjacent the mated terminals. This problem is generally the result of inadequately protecting the terminals from the deleterious effects of the elements.

Another problem with the electrical connectors described above concerns coupling and uncoupling the plug and receptacle of the connector. In this regard, the location of the connectors on the vehicle firewall is generally in an area not readily accessible, thereby making manual manipulation of the plugs extremely difficult. Moreover, weathering of the connector over long periods of use often makes it almost impossible to uncouple the plug and receptacle without damaging one or the other. Of course, the force required to couple and uncouple the plug and receptacle increases with the number of contacts in the connector. This factor has heretofore imposed a limit on the number of contacts in connectors of this type. Appurtenant to the coupling problem is that of providing a simple locking means for maintaining mating engagement between the plug and receptacle during the service life of the vehicle.

Yet another problem with installations of the type described relates to removing the receptacle from its securement with the firewall when it is desired to refurbish the vehicle. This problem is particularly acute in heavy duty trucks which may undergo numerous extensive overhauls during their service life. Typically the connector receptacle is mounted in a semi-permanent manner such that removal of the latter for replacement is often difficult and time-consuming.

DISCLOSURE OF INVENTION

The present invention concerns an electrical connector having a universal receptacle adapted to mate with several combinations of plug sizes while maintaining positive polarity control for each of the plugs in the combination.

The receptacle has an ordered arrangement of female connector terminals each adapted to receive a complemental male connector terminal on one of the mating plugs. Also, the receptacle has a number of male connector terminals positioned within the arrangement of female connector terminals in a manner calculated to provide positive polarity control for the mating plugs. In one embodiment of the invention, additional polarization is provided by a formed keyway in the receptacle adapted to receive a complemental key on one of the mating plugs.

The receptacle is exteriorly resilient to form weatherseals with the mating plugs in the areas adjacent the coupled terminals. At the same time, a rigid central core in the body of the connector provides needed strength and shape-retention for positive mating with the plugs.

Additionally the invention concerns the provision of a threaded bolt captively secured to each plug and adapted to be received within a complemental threaded insert in the rigid core of the receptacle. In this manner, coupling and uncoupling of the plug and receptacle is simply a matter of turning the bolt in the appropriate direction; the bolt and insert combination also serves to lock the plug and receptacle in mating engagement as desired.

The present invention also has a securement for releasably attaching the receptacle to a firewall whereby removal of the receptacle as desired is but a simple matter. A U-shaped elastically deformable clip cooperates with a circumscribing flange on the receptacle to hold the receptacle within an opening formed in the firewall.

BRIEF DESCRIPTION OF THE DRAWINGS

FIG. 5 is an enlarged end view of the receptacle of the connector shown in FIGS. 1 and 2;

FIG. 6 is an enlarged end elevational view of a pair of plugs adapted to mate with the receptacle shown in FIG. 5; and FIG. 7 is an elevational view showing the plugs of FIG. 6 coupled with the receptacle of FIG. 5;

FIG. 8 is an end elevational view of the receptacle in a second embodiment of the invention;

FIG. 9 is an end elevational view of three plugs adapted to mate with the receptacle shown in FIG. 8; and FIG. 10 is an elevational view showing the plugs of FIG. 9 in mating engagement with the receptacle of FIG. 8.

DETAILED DESCRIPTION

Figure 1:
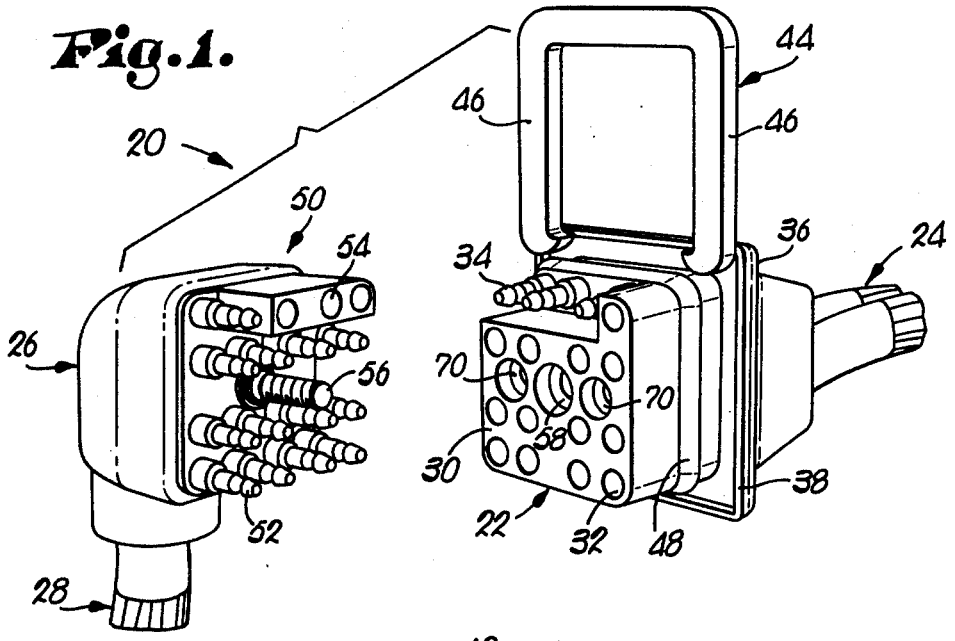
FIG. 1 is a perspective view of a multiple contact connector having a universal receptacle adapted to receive different plugs.

In FIGS. 1–7 there is shown a heavy duty, multiple contact electrical connector 20 of the type intended for mounting in the firewall of a motor vehicle. The connector 20 includes a universal receptacle 22 secured on one end of a multiple wire harness 24, and a plug assembly 26 attached to a corresponding multiple wire harness 28. Plug 26 is adapted to mate with the receptacle 22 to establish a number of discrete electrical contacts interconnecting the wires of harness 24 with respective wires of harness 28.

The receptacle 22 includes a generally prismoidal central body 30 molded from a synthetic resin material such as polyvinyl chloride, a plurality of female electrical connector terminals 32 each coupled with a different wire in the harness 24, and three male electrical connector terminals 34 also each coupled with separate wires in the harness 24. As shown for example in FIG. 5, the terminals 32, 34 are arranged in a radially asymmetrical array comprising four rows of four terminals each, the male terminals 34 being disposed in successive positions in the same row. The terminals 32, 34 extend substantially parallel to the longitudinal axis of the body 30.

Figure 2:
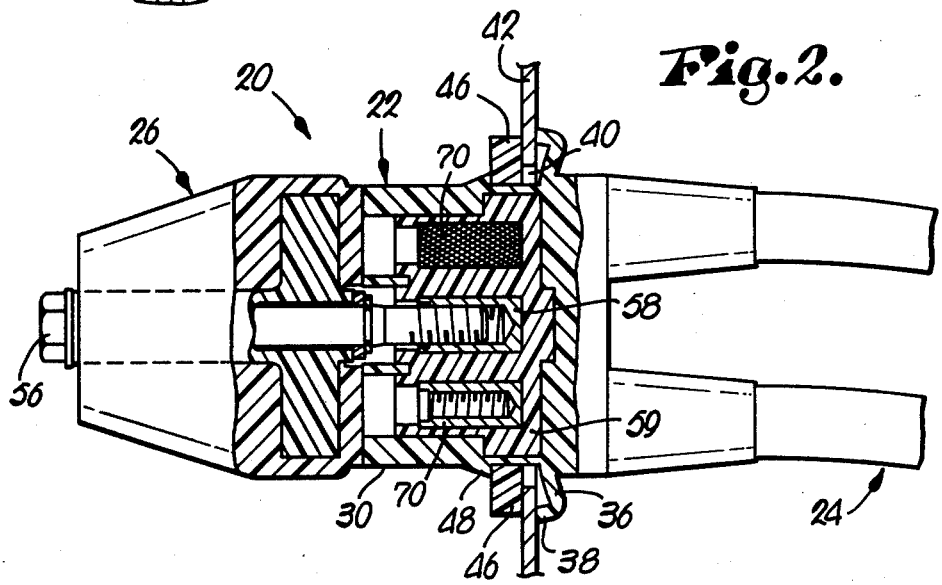
FIG. 2 is an enlarged top plan view of the connector with portions shown in section to reveal details of construction.

A resilient flange 36 integral with the body 30 extends in generally circumscribing relation to the latter from the central periphery thereof, and presents a continuous outturned rim 38. The receptacle 22 is adapted to be received within a complementally configured opening 40 in the firewall 42 as shown for example in FIGS. 2 and 5. A removable U-shaped retainer clip 44 cooperates with the flange 36 to form a keeper for releasably securing the receptacle 22 to the firewall 42. As shown in FIG. 2, a pair of deformable legs 46 on the clip 44 grippingly engage the central portion of the body 30 in spaced relation from the flange 36 to captively retain the firewall 42 therebetween.

A raised ridge 48 extends substantially around the periphery of the body 30 and serves to preclude movement of the retainer clip 44 in a direction away from the flange 36. As shown clearly in FIG. 2, the position of ridge 48 relative to the flange 36 is such that the latter is slightly deformed when the receptacle 22 is supported on the firewall 42 whereby the outturned rim 38 is biased against the firewall 42 to form a weathertight seal with the latter.

The plug assembly 26 includes a single sixteen-terminal plug 50 having a plurality of male connector terminals 52 complemental in number and arrangement to the female terminals 32 of receptacle 22, and three female connector terminals 54 positioned to mate with the three male terminals 34. An elongate threaded bolt 56 is captively rotatably mounted on the plug 50 centrally thereof and adapted to be received within a mating threaded insert 58 to facilitate coupling and uncoupling of the plug 50 and the receptacle 22. The bolt 56 and insert 58 also cooperate to lock the plug 50 in engagement with the receptacle 22 even under high vibration conditions encountered in most vehicles.

In order to provide the receptacle 22 with adequate strength and shape-retention for mating with the plug 50, the body 30 has a rigid central core 59 formed therein. The core 59 retains the insert 58 such that forces imparted by the bolt 56 are not transmitted in a manner to deform the body 30.

The terminals 52 and 54 are connected to separate wires in the harness 28 just as the terminals 32, 34 are coupled to wires in harness 24. The terminals 52 are substantially identical in construction to the terminals 34 on receptacle 22 and likewise, the terminals 54 have the same construction as the terminals 32.

Figure 4:
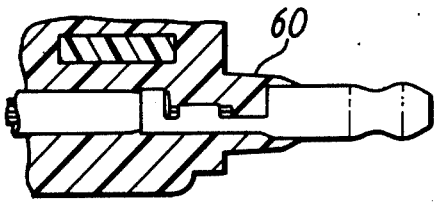
FIG. 4 is an enlarged, cross-sectional view of a male connector terminal on the plug illustrated in FIG. 1.
Figure 3:
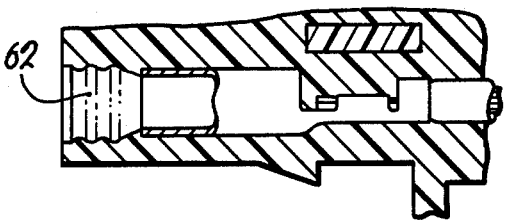
FIG. 3 is an enlarged, cross-sectional view illustrating a female connector terminal of the receptacle.

As shown in FIGS. 3 and 4, the male terminals 34 and 52 are adapted to be complementally received within respective female terminals 32, 54. Moreover, the base of each male terminal 34, 52 has a resilient tapered section 60 adapted to sealingly engage a corresponding flexible annular opening 62 presented at the outermost portion of each female terminal 32, 54. In this manner, a weathertight seal is formed between each of the mating terminals to preclude undesired corrosion and resultant degradation of the electrical contact established by the mating terminals. It is noted that the section 60 and opening 62 adjacent terminals 34, 32 respectively are particularly adapted for forming tight weatherseals by virtue of the resilient nature of body 30.

An alternate plug assembly, identified as 26*a* in FIGS. 6 and 7, comprises a pair of eight-terminal plugs 64, 66 adapted to mate with the receptacle 22 in a predetermined orientation. Plug 66 has seven male connector terminals 52 and a single female connector terminal 54 whereas the plug 64 has six male connector terminals 52 and a pair of female connector terminals 54. The terminals 52, 54 in each of the plugs 64, 66 are arranged in two rows of four terminals each. Additionally, each plug 64, 66 is provided with a captively retained, centrally disposed threaded bolt 68, corresponding to the bolt 56 of plug 50, and adapted to be received within respective threaded inserts 70 molded in the core 59 of receptacle 22. Note that by the provision of plugs 64, 66 in assembly 26*a*, the wire harness 28 may be conveniently divided into two sections 28*a* and 28*b*, each being associated with a respective plug 64, 66. Thus, there is provided added flexibility to meet the particular design needs of a vehicle utilizing the connector 20.

An important feature of the present invention is the fact that plug 50 of plug assembly 26 and plugs 64, 66 of plug assembly 26a can mate with universal receptacle 22 in only one orientation and position. The unique arrangement of the male connector terminals 34 relative to the female terminals 32 on receptacle 22 operates in combination with a corresponding arrangement of mating terminals 52 and 54 in both plug assembly 26 and 26a to automatically preclude mislocation of the plugs 50 or 64, 66 relative to the receptacle 22. In this manner, polarity across the connector 20 is guaranteed such that each wire in the harness 28 can be coupled only with an appropriate wire in the associated harness 24.

In FIGS. 8–10 there is shown a second embodiment of the present invention in the form of a multiple contact electrical connector 120 comprising a universal receptacle 122 attached to one end of a wire harness 24 (not shown) and adapted to mate with a plug assembly 126 attached to a multiple wire harness 128.

As shown in FIG. 9, the plug assembly 126 comprises a pair of four-terminal plugs 130, 132 in combination with an eight-terminal plug 134. The plugs 130, 132 and 134 are coupled with respective harness portions 128a, 128b, and 128c. The plug 134 is identical in construction to the plug 64 of connector 20, having a captive threaded bolt 68, six male terminals 52 arranged in rows, and a pair of female terminals 54 positioned as shown in FIG. 9.

The plug 130 is provided with three male terminals 52 and a single female terminal 54 whereas the plug 132 has a pair each of terminals 52 and 54.

The receptacle 122 is identical in construction to the receptacle 22 with the exception that there is provided two additional male terminals 34 substituted for female terminals 32 at the locations shown in FIG. 8. There is additionally provided a keyway 136 formed in the body 30 of the receptacle 122 adjacent the two additional male terminals 34 for the purpose of maintaining polarity of the plug 132. In this regard, a key 138 is formed in the plug 132 and adapted to be complementally received within the keyway 136 when plug assembly 126 is mated with the receptacle 122.

In comparing FIGS. 8 and 9, it is clear that the plug assembly 126 is configured to complementally engage the receptacle 122 in the manner shown for example in FIG. 10. Moreover, the unique configuration of the plugs 130, 132 and 134 in combination with the arrangement of the receptacle 122 assures that each of the plugs in assembly 126 can mate with the receptacle 122 in only one position and orientation. Thus, as in connector 20, polarity is maintained across the connector 120 such that the wires in harness 128 are mated with corresponding wires in the harness 24.

Though not shown, it is contemplated that the plug assembly 126 might include only a single sixteen-terminal plug configured to mate with the receptacle 122 or a pair of eight-terminal plugs similarly adapted to mate with the receptacle 122. It will be appreciated that the unique design of the receptacle 122 allows the use of such a plug or combination of plugs without sacrificing the polarity assurance feature of the present invention. Thus, when utilizing the connector 120, the vehicle designer is presented with an even more versatile tool for economically custom tailoring a system to meet the needs of a particular application.

It is also contemplated that a number of receptacles 22 might be utilized in a single electrical system. In such instances, each receptacle 22 preferably would be provided with a distinct, radially asymmetrical array of terminals 32, 34 in order to prevent undesired cross connection of the mating plugs 50.

INDUSTRIAL APPLICATION

The use of the present invention should be apparent from the foregoing detailed description. As explained, the connectors 20 and 120 are intended to be used in the electrical system of a motor vehicle at the interface between the system and the vehicle firewall.

The universal receptacle 22 can be employed with either the sixteen-terminal plug 50 or the eight-terminal plugs 64, 66 without running the risk that the plugs will be misoriented with respect to the receptacle 22. The automatic polarizing feature built into the receptacle 22 gives the designer of vehicle electrical systems a degree of flexibility not heretofore available in this area.

The unique releasable mounting means defined by the retainer clip 44 in cooperation with the flange 36 allows the connector 20 to be readily removed from the vehicle during repair or redesign operations. The legs 46 need be merely slightly deflected to release their gripping engagement with body 30 of the receptacle 22 to thereby permit clip 44 to be easily removed from its retaining position.

The exterior resiliency of body 30 renders it adaptable to forming weatherseals with the firewall 42 and adjacent terminals 32, 34. At the same time, the rigid central core 59 of body 30 renders the receptacle 22 sufficiently strong to mate with plug assembly 26. Additionally, the core 59 provides needed strength to retain the inserts 58, 70.

Finally, the threaded bolts 56, 68 in combination with mating inserts 58, 70 permit ready coupling and uncoupling of the plug assembly 26 with the receptacle 22 even in areas where only limited manual access is allowed. This feature is particularly important when utilizing the plug 50 in combination with the receptacle 22 in view of the fact that it is extremely difficult to manually force these two components together. Of course, as previously explained, the bolts 56, 68 and inserts 58, 70 function to lock the plug assembly in mating engagement with the receptacle 22 as desired.

For the foregoing reasons, it is clear that the present invention offers significant advantages over devices heretofore commercially available as well as others known in the prior art.

What I claim is:

1. In a multiple contact connector, a universal receptacle for mating with a plug assembly comprising either a single multiple terminal plug or various combinations of smaller plugs, said universal receptacle including:

a formed body;

a plurality of female connector terminals supported on said body; and a number of male connector terminals carried on the body, said male terminals being arranged relative to said female terminals in a manner to permit only one orientation and position for each of said plugs relative to said receptacle, whereby polarity across the connector is assured for all combinations of plugs.

2. The invention of claim 1, said body having a resilient exterior for forming a weatherseal with said plug assembly at each of said terminals, said body having a rigid central core to provide adequate strength for mating with said plug assembly.

3. The invention of claim 2; and means for mechanically coupling and uncoupling said receptacle and plugs, said means including a threaded bolt adapted to be captively retained centrally within each of said plugs, and a threaded insert in said core for each of said threaded members, said coupling means serving to releasably lock said receptacle and plug assembly in mating engagement.

4. The invention of claim 3, said receptacle having sixteen of said terminals arranged in four rows of four terminals each.

5. The invention of claim 4, there being three of said male terminals, the latter all being disposed in the same row.

6. The invention of claim 1, said base having a keyway formed therein adjacent one of said male terminals adapted to complementally receive a key on one of said plugs.

7. The invention of claim 6, said receptacle having sixteen of said terminals, the latter being arranged in four rows of four terminals each.

8. The invention of claim 7, there being five of said male terminals, three of said male terminals being disposed in one of said rows, the remainder of said male terminals being disposed in a second row remote from said one row.

9. In a motor vehicle having a firewall, a multiple contact connector forming an electrical interface for circuits of the vehicle electrical system passing through the firewall:

a unitary receptacle including a resilient central body supporting a plurality of female connector terminals;

a plug assembly including a complemental first number of male terminals for mating with said female terminals when said assembly and said receptacle are coupled together; and polarizing means for permitting said plug assembly to be coupled with said receptacle in only a single predetermined orientation whereby to maintain polarity across the connector, said polarizing means including a number of second male connector terminals on said receptacle forming a radially asymmetrical array with said first female terminals thereon, and complemental second female connector terminals on said plug assembly disposed to mate with said second male terminals, said plug assembly comprising a plurality of plugs each having terminals thereon, the total number of terminals on said plugs being equal to the number of terminals on said receptacle.

10. The invention of claim 9, and means for releasably mounting said receptacle in an opening through said firewall, said means including an integral flange on the resilient body of said receptacle adapted to abut against one side of said firewall adjacent the periphery of said opening, and a deformable clip adapted to releasably engage said body in spaced relation from said flange whereby said firewall may be captively retained between said flange and said clip when the body is positioned within said opening.

11. The invention of claim 10, said clip being generally U-shaped, having a pair of elastically bendable legs adapted to grippingly engage the body of said receptacle, said body having a circumscribing, clip-engaging raised ridge for precluding movement of said clip in a direction away from said flange.

12. The invention of claim 10, said flange having a resilient raised rim adapted to sealingly engage the firewall adjacent said opening when the receptacle is mounted thereon.

13. The invention of claim 9, said plug assembly comprising a pair of plugs each having half as many terminals as said receptacle.

14. The invention of claim 13, each of said plugs having at least one second female terminal.

15. The invention of claim 9, said plug assembly comprising three plugs, one plug having half as many terminals as said receptacle, the other two plugs each having one-fourth as many terminals as said receptacle.

16. The invention of claim 15, each of said plugs having at least one second female terminal.

* * * * *